US006213176B1

(12) United States Patent
Wolf et al.

(10) Patent No.: US 6,213,176 B1
(45) Date of Patent: Apr. 10, 2001

(54) DEVICE FOR WORKING OF TREE TRUNKS

(76) Inventors: Johann Wolf, Muhldori 86, A-4644 Scharnstein (AT); Dale Sanborn, P.O. Box 245 Rte. 37, South Waterford, ME (US) 04088

( * ) Notice: Subject to any disclaimer, the term of this patent is extended or adjusted under 35 U.S.C. 154(b) by 0 days.

(21) Appl. No.: 09/501,535

(22) Filed: Feb. 9, 2000

(30) Foreign Application Priority Data

Feb. 9, 1999 (AT) ..... 169/99

(51) Int. Cl.[7] ..... B27B 31/00; B27B 1/00; B27L 7/00

(52) U.S. Cl. ..... 144/242.1; 83/435.11; 144/2.1; 144/3.1; 144/39; 144/369; 144/246.1; 144/248.5; 144/357

(58) Field of Search ..... 144/2.1, 3.1, 39, 144/41, 242.1, 250.21, 250.12, 356, 357, 369, 373, 374, 375, 376, 377, 378, 367, 246.1, 248.5; 414/749.6, 746.8; 83/435.11

(56) References Cited

U.S. PATENT DOCUMENTS 4,147,259 * 4/1979 Nilsson ..... 144/242.1
4,294,149 * 10/1981 Olsson ..... 144/242.1
5,224,536 * 7/1993 Wolf ..... 144/242.1
5,472,028 * 12/1995 Eaulhaber ..... 144/242.1

FOREIGN PATENT DOCUMENTS 27 40 985 3/1978 (DE) .
29 47 993 7/1981 (DE) .
32 28 224 2/1984 (DE) .
33 17 303 11/1984 (DE) .
36 07 980 9/1987 (DE) .
42 13 553 11/1992 (DE) .
197 15 139 12/1998 (DE) .

* cited by examiner

*Primary Examiner*—W. Donald Bray
(74) *Attorney, Agent, or Firm*—Young & Thompson

(57) ABSTRACT

A device for producing squared timber from tree trunks includes a feed section, a machining center, and a delivery section; the feed section has at least two grippers which can be placed against the tree trunk to be machined and using which the tree trunk is supplied to the machining center; the machining center has several plan cutters and feed rollers in order to advance the tree trunk, while it is machined by cutting at the desired locations. The square beam is transported from the machining center onto the delivery section and then removed for further machining. The grippers may be made such that they hold the tree trunk regardless of its diameter at a height which at least roughly corresponds to the axis of the machining center.

13 Claims, 2 Drawing Sheets

DEVICE FOR WORKING OF TREE TRUNKS

BACKGROUND OF THE INVENTION

The invention relates to a device for working of tree trunks to produce squared timbers from them with a machining center, with a feed section which is located in front of the machining center viewed in the machining direction, and with a delivery section which viewed in the machining direction is located after the machining center, and with grippers which can be moved relative to the machining center on carriages in the feed section for pushing the tree trunks to the machining center.

DESCRIPTION OF THE RELATED ART

UP 5 28 490 A discloses a device for working of tree trunks with a machining center, with a feed section and a delivery section in which there is a gripper for supplying the tree trunks to the machining center.

SUMMARY OF THE INVENTION

The object of the invention is to make available a device of the initially mentioned type with which with a high throughput and with a structural length of the device which is as short as possible at the same time tree trunks can be machined by trimming, for example into square beams, square beams with bevelled edges or into the octagonal beams.

This object is achieved using a device which is characterized by the fact that at least two grippers are fork tongs, that each gripper has two sides which are joined to one another to swivel around a common axis which is located underneath the axis of the machining center, that the sides of the grippers are supported to swivel on extension arms which point downward from the carriages, that the grippers can be closed by swivelling their sides concentrically to the center axis of the machining center, and that the tree trunks are held by the sides of the gripper with an axis which lies essentially in the axis of the machining center.

In the device of the invention tree trunks are supplied to the machining center, for example using chain conveyors, the feed section and from the feed section. In the machining center the tree trunks are worked into squared timber of the shape and dimensioned as desired at the time. For example square beams, square beams with oblique edges, square beams with rough edges or for example octagonal beams can be produced.

In the feed section of the device of the invention there are movable, tong-like grippers with which the tree trunks are supplied to the machining center. The grippers can be set up such that they hold a tree trunk during feed into the machining center, it being guaranteed by the shape and design of the grippers that the grippers close concentrically to the center axis of the machining center and guide the tree trunk independently of its diameter, such that the axis of the tree trunk is essentially in the axis of the machining center.

The sides of the gripper which engage the tree trunk are supported to swivel around one axis which can have a distance as large as possible from the axis of the machining center, so that the parts of the sides of the gripper which engage the tree trunks move along a circular path with a large radius so that in the affected area of motion of the sides of the gripper the deviation from linear motion is negligibly small.

To open and close the sides of the grippers hydraulic cylinders can engage the sides formed lengthwise via levers.

The grippers (there are at least two such grippers) are mounted on carriages. The carriages can move preferably on a bed. Here an embodiment is preferred in which only the gripper which is farther from the machining center is coupled to a drive, for example a rack-and-pinion gear, since the other gripper is moved along the bed by engagement with the tree trunk which is supplied to the machining center. In one practical embodiment it is preferably provided that the carriages can move on guide rails which are provided on a bed-shaped frame.

Reliable movement of the fork tongs of the grippers arises in the invention when there is a hydraulic cylinder which engages the sides via two push rods to adjust the sides of the grippers.

In another embodiment the sides of the grippers have V-shaped recesses with edges which can be placed against the tree trunk to be held. Here it is preferred if the center of the surface which is bounded by the V-shaped recesses in the sides of the grippers is in the axis of the machining center. In this embodiment it can be provided that the lower edges of the V-shaped recesses are longer than their upper edges. It is advantageous when the lower, longer edges of the V-shaped recesses in the sides of the grippers, especially when the latter are placed against the tree trunk, can overlap one another, for which the sides of the grippers are supported offset laterally for example on the carriages or the sides can be made bent at right angles.

In the invention it can be provided that the sides of the grippers, especially on their upper edges, carry optionally driven reversible rolls for a tree trunk. This embodiment makes it possible to turn a tree trunk which has been placed on the still closed grippers such that it assumes the position which is most favorable for producing beams in the machining center. For example, the tree trunk is turned until deformities or curves of the tree trunk which are present anyway have been set into a favorable position. These optionally driven rollers can also be located in the area of the lower edges of the V-shaped recesses in the sides of the grippers.

To achieve automatic closing of the grippers, it can be provided that an operating lever is assigned to at least one of the grippers in the area of its bit which is formed by the V-shaped recesses in the sides and the lever triggers actuation of the hydraulic cylinder to close the grippers. In doing so it can still be provided that the operating lever is connected to a valve which joins the hydraulic cylinder of the gripper to a storage tank for the hydraulic fluid.

Preferably the grippers are positioned in the initial position in which they are supplied with a tree trunk such that they grasp the tree trunk to be worked in the area of its ends. Automatic triggering of advance of the tree trunk after it is inserted into the grippers can take place for example such that the increase of pressure in the hydraulic medium which actuates the actuating cylinder for the gripper sides after closing of the grippers—if therefore one tree trunk is held by the grippers—is used in order to open a pressure-dependent valve which triggers the drive for the advance motion for the gripper carriages.

Here it is preferable if the advance motion begins with a time delay so that enough time remains to position the cutting tools according to the desired machining result.

In one embodiment of the invention it is provided that a feed drive for positioning the grippers in the direction to the machining center is assigned to at least one of the two carriages.

One economical embodiment arises when solely the carriage which carries the gripper which is located farther from the machining center is coupled to a feed drive.

Automatic interruption or shutdown of the advance of the gripper arises when a sensor is assigned to the gripper which is nearer the machining center and when the gripper or its carriage runs against the machining center, the sensor causes the sides of this gripper to be released from the tree trunk. In addition, it can be provided that a sensor is assigned to the carriage which carries the gripper which is located farther from the machining center and when the carriage runs against the carriage of the gripper which is located nearer the machining center, the sensor shuts down the feed for this carriage.

As soon as the gripper which is located nearer the machining center has reached the feed-side end of the machining center, for example a spring-loaded test finger triggers the opening of this gripper and the gripper remains stationary with the opened sides which therefore do not further engage the tree trunk near the machining center (inlet side). Guidance of the tree trunk now is assumed by the machining center itself and the gripper which is farther from the machining center continues to push the tree trunk forward. To release the second gripper from the tree trunk when it has arrived at the first gripper waiting near the machining center, the second gripper also has a test finger which triggers opening of the gripper so that finally the tree trunk continues to be conveyed solely by the advance means which are provided in the machining center itself.

Pulling the grippers back into their initial position can take place using a pulling means such as a cable or chain which is wound onto a drum, when the grippers are moved back into their initial position. Alternatively, to pull the grippers back into their initial position, there can be a hydraulic drive, preferably in the form of a multiple hydraulic cylinder. When there is one such hydraulic drive it can also be used (instead of the rack and pinion drive) to push the grippers forward, especially the gripper farther away from the machining center, when a tree trunk is being machined. In addition, the feed drive (rack and pinion drive) which is assigned to the gripper which is farther from the machining center can be used to move the grippers back into their initial position. In this version the grippers can be coupled to one another so that the gripper which is located nearer the machining center at the end of the movement of the gripper located farther away is also moved back by the latter into its initial position. After this has happened, the two grippers are all ready opened to pick up the next tree trunk and feed it to the machining center.

The machining center which is provided in the device as claimed in the invention can be made for example as follows:

On the input side of the machining center there are two trimming tools, for example roller-shaped cutting devices (plan cutters) with horizontally aligned axes of rotation which can be vertically and centrally adjusted. In addition to the input side trimming tools (plan cutters) there are feed devices, for example corrugated feed rolls which engage the tree trunk which has already been trimmed at the top and bottom. The corrugated feed rolls lie prestressed on the tree trunk so that reliable feed is ensured. When the feed rolls are pressed by powerfully spring-loaded means, there is an area of elastic motion which allows adaptation of the feed rolls to the tree trunk.

The top and bottom rough edge of the tree trunk is removed, especially milled off, by the trimming tools which are provided on the inlet side, for example, plan cutters. Following the feed rolls, there are two other trimming tools, for example plan cutters, with axes of rotation which are essentially vertical, but in any case perpendicular to the axes of the input-side plan cutters. With these other trimming tools the side rough edges of the tree trunk are trimmed, especially milled off. Following the other trimming tools which produce side surfaces on the tree trunk by working off (milling), there can be transport and/or guide rolls with vertical axes of rotation.

If desired, there can be other trimming tools (molding cutters) which are aligned for example by 45° to the preceding trimming tools (plan cutters) in order to mill off the rough edges which may still be present on the four edges of the tree trunk and for example to produce a square beam with bevelled edges.

On the outlet side of the machining center there is a conveyor device for the now trimmed tree trunk, therefore the squared timber. This conveyor device can for example be a pair of corrugated rollers with a downstream roller table or a gear chain feed. If there is a ladder chain feed, corrugated rollers located on the outlet side of the machining center are not necessary.

Following the machining center the worked tree trunks are moved away especially laterally by the delivery section.

The means as claimed in the invention makes it possible to produce different profiles, for example square, squares with beveled edges or octagonal edges from tree trunks.

To determine the diameter of the tree trunk there can be a rotary pulse generator which acquires the swivel position of the sides of the gripper which is located next to the machining center. The rotary pulse generator relays data corresponding to the diameter of the tree trunk held by the gripper to a computer. The computer determines the corresponding position of the axes of the trimming tools using an optimization program which is matched to the profile to be produced and to the diameter of the tree trunk and takes into account these entries. The computer can also be programmed such that with consideration of the determined diameter of the tree trunk which has been supplied to the machining center, using an optimization process it establishes the profile of the squared timber and positions the trimming tools accordingly. This ensures that as little cutting as possible occurs and the supplied tree trunks are optimally worked into the desired squared timbers. To adjust the trimming tools into their positions which have been determined by the computer there can be for example electrical servomotors or hydraulic positioning means.

As soon as the trimming tools controlled by the computer have been moved into their positions, the computer releases the feed of the tree trunk by the grippers.

In the machining center there can be tools for producing lengthwise grooves in the resulting squared timber. In doing so at least one lengthwise groove is produced which is intended to relieve stresses in the wood fibers to prevent later splintering of the beam. These grooves can be machined on the bottom and/or the top of the squared timber which has been produced for example using at least one circular saw blade.

BRIEF DESCRIPTION OF THE DRAWINGS

Other details, advantages and features result from the following description of the embodiments which are shown in the drawings.

DESCRIPTION OF THE PREFERRED EMBODIMENTS

Figure 1:
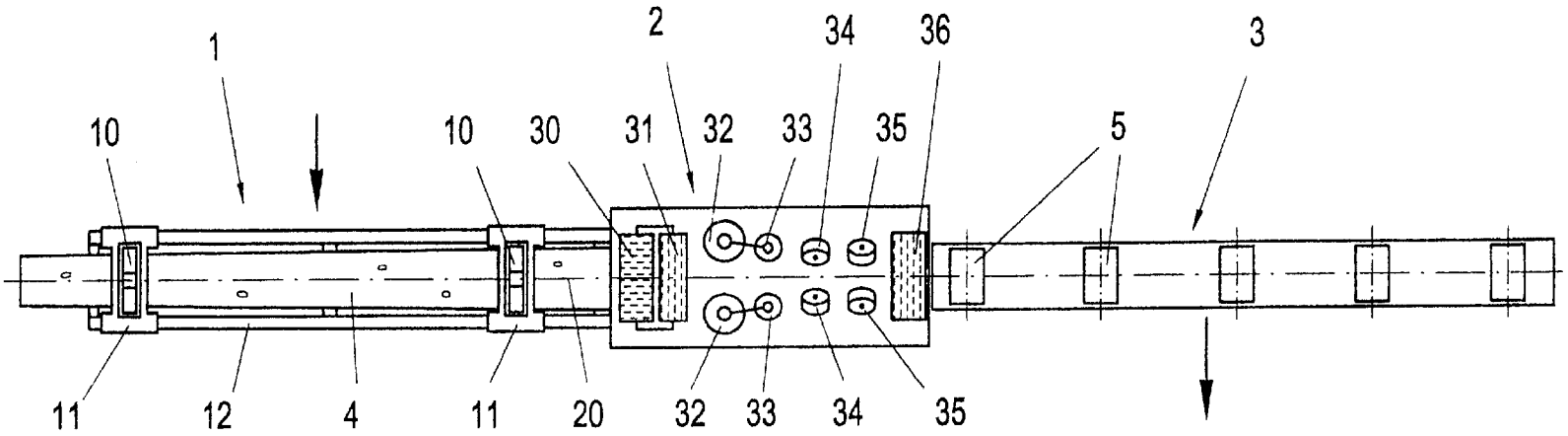
FIG. 1 show in partially schematic form and in an overhead view a device as claimed in the invention with the feed section, machining center and the delivery section.

As FIG. 1 shows, the invention includes of a feed section 1, a machining center 2 and a delivery section 3. The feed section 1 is used to supply to the machining center 2 the tree trunks 4 which are processed in the machining center 2 into squared timbers. The delivery section 3 which is made for example as a roller table is used to remove the squared timbers which are produced in the machining center 2.

In the feed section 1 which precedes the machining center 2 there are two grippers 10 which are made as fork tines. The grippers 10 are each mounted on one carriage 11, the carriages 11 being movably guided on a bed 12 which extends to in front of the machining center 2.

Figure 2:
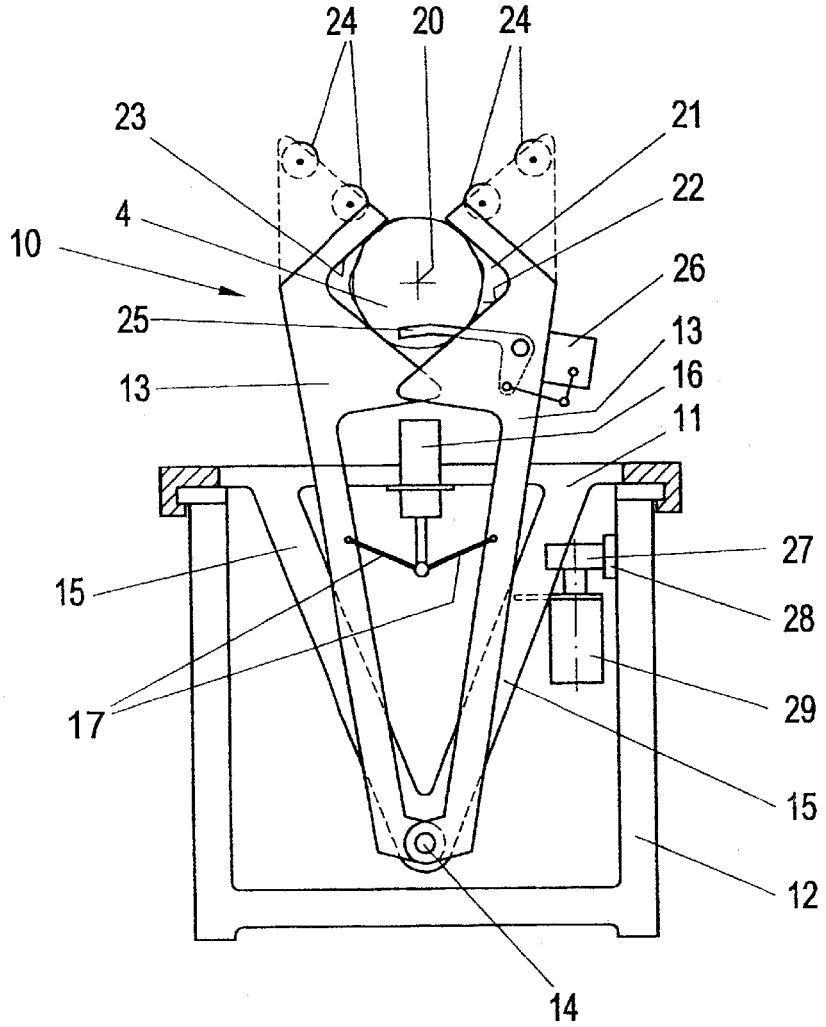
FIG. 2 shows on an enlarged scale a gripper.

The grippers 10 can be made as shown in FIG. 2. The sides 13 of the grippers 10 are articulated to one another to be able to swivel around an axis 14 which has a distance as large as possible from the axis 20 of the machining center 2 which should be equal to the axis of the supplied tree trunk 4. To do this the sides 13 of the grippers 10 are supported to be able to swivel on extension arms 15 which point downward from the carriage 11. To actuate the sides 13 of the grippers there are hydraulic cylinders 16 which are coupled via levers 17 to the sides 13 of the grippers 10.

The grippers 10 in the upper area of their sides 13 have V-shaped recesses 21 with which they can be placed against a tree trunk 4. As is shown in FIG. 2, the lower edges 22 of the V-shaped recesses 21 are made longer than the top edges 23 and overlap one another at least in the position in which the grippers 10 are placed against the tree trunk.

As is shown in FIG. 2 by the broken line, on the upper ends of the sides 13 of the grippers 10 there can be rollers 24 which allow turning of the tree trunk 4 around its lengthwise axis in order to optimally align it for further working. Here it is preferable that at least some of the reversible rolls 24 are rotary-driven by a drive in order to facilitate turning.

When a tree trunk 4 is inserted into an opened gripper 10, it presses down the operating lever 25 which opens a valve 26 which joins the hydraulic cylinders 16 of the two grippers 10 to a hydraulic fluid source so that the sides 13 of the grippers 10 are placed with their V-shaped recesses 21 against the tree trunk 4 and fix it aligned centrally relative to the axis 20 of the machining center 2.

Here it is intended that, as shown in FIG. 1, the two grippers 10 are placed against a tree trunk 4 and the tree trunk 4 is preferably inserted into the grippers 10 such that its thicker (root-side) end is located nearer the machining center 2 than its thinner end.

In the embodiment which is shown in FIGS. 1 and 2 a drive, for example the rack 28 and pinion 27 drive which is shown schematically in FIG. 2, is assigned only to the carriage 11 of the grippers 10 which is located farther away from the machining center 2. In this drive the pinion 27 of an electric motor 29 which is mounted on the carriage 11 engages a rack 28 which is attached to the bed 12.

Here it is preferred that only the carriage 11 of the gripper 10 which is located farther away from the machining center 2 is connected to a drive.

In one preferred embodiment it can be provided that after inserting or throwing a tree trunk 4 into the opened grippers 10 and after closing them the pressure which rises towards the end of the closing process in the hydraulic medium which actuates the hydraulic cylinder 16 actuates a valve which is controlled depending on pressure and which starts the feed drive for the gripper 10 which is located farther away from the machining center 2.

The tree trunk 4 is now inserted into the machining center 2 and is machined first by two plan cutters 30 which are rotary-driven around the horizontal axes such that the upper and lower rough edge is milled off. The plan cutters can be adjusted symmetrically to the axis 20 of the machining center 2 and are aligned such that the supplied tree trunk 4 is trimmed in the desired amount (optimized by the computer) by cutting to the top and bottom. The corrugated transport rollers 31 which are located following the plain cutters 30 from the top and bottom engage the flat surfaces of the tree trunk 4 which are parallel to one another and which are formed in this way.

This makes it possible for the gripper 10 which is located nearer the machining center 2 to release the tree trunk 4 as soon as this gripper 10 is located on the inlet side next to the machining center 2. To do this, on the gripper 10 or on its carriage 11 there can be a test finger which causes the hydraulic cylinder 16 to be actuated and the sides 13 to be swivelled such that the gripper 10 releases the tree trunk 4.

Both the relative distance of the plan cutters 30 and also that of the transport rollers 31 from one another can be adjusted in order to match their position to the dimensions of the tree trunk 4 and the dimensions of the desired squared timber. Here it is preferred that the distance of the working surfaces of the transport rollers 31 from one another is somewhat smaller than the distance of the plan cutters 30 from one another so that the transport rollers 31 engage the top and bottom cut surface of the tree trunk 4 with the corresponding prestress (pressure) and this provides for reliable feed.

It is preferable for the plan cutters 30 to be adjustable relative to the axis 20 of the machining center 2 diametrically opposite by the same lengths. The corresponding applies to the transport rollers 31 as well.

Following the inlet-side transport rollers 31 of the machining center 2, in it there are plan cutters 32 which are rotary driven around the vertical axes and which likewise can be adjusted by the same lengths diametrically opposite relative to the axis 20 in order to remove the two lateral rough edges of the tree trunk 4 by milling off. Following the plan cutters 32 which can be rotated around vertical axes there can optionally be rotary-driven guide rollers 33 which from two sides engage the tree trunk 4 which is now machined on four sides.

If desired, there can be other molding cutter pairs 34, 35 to mill off the remaining (four,narrow) rough edges on the tree trunk 4 if need be in the machining center 2 in order to obtain a square profile timber with bevelled edges. Following these molding cutters 34, 35 which are positioned obliquely by 45° there is still one pair of transport rollers 36 which transports the tree trunk which has now been machined into a squared timber onto the delivery section 3 which is made in the embodiment as a roller table 5.

The rolls of the roller table 5 which forms the delivery section 3 are vertically adjustable to match them to the location of the bottom of the squared timber which has been produced. To do this there can be an electrical control (FIG. 3) or a mechanical control (FIG. 4), which latter is coupled via a rod for example to the positioning motor 48 (hydraulic cylinder) for the pair of plan cutters 30 provided on the inlet side of the machining center 2.

The different profiles such as squares, squares with beveled edges or octagons are established by the corresponding adjustment of the different trimming tools (molding cutters) 30, 32, 34, 35. The control provided for this purpose is coupled to a means for acquiring the diameter of the tree trunk 4 clamped in the grippers 10. For example, the measured quantity for the diameter of the clamped tree trunk can be the swivel angle of one or both sides 13 of the grippers 10. The data which have been determined in this way and which correspond to the diameter of the clamped tree trunk 4 are relayed to the computer. The computer has an optimization program which is matched to the input profile to the diameter of the tree trunk 4 or assigns the optimum profile to the diameter which has been acquired for example as described above. The trimming tools in the machining center 2 are positioned according to this assignment.

Figure 4:
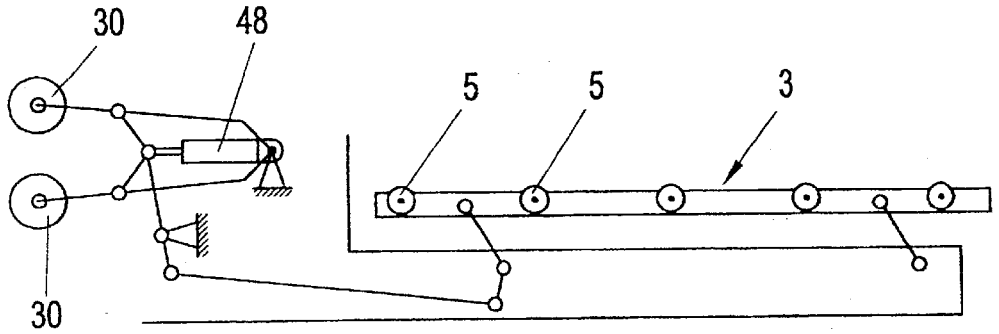

To adjust the various tools and transport rollers in the machining center 2 there can be electric servomotors, or there can be hydraulic mechanical adjustment as is shown in FIG. 4 for the input-side pair of plan cutters 30. As soon as the tools are positioned according to the entries of the computer, the feed for the grippers 10 and thus for the tree trunk 4 is released.

Due to the irregular shape of the tree trunks it can happen that at the start of their entry into the machining center 2 the inlet-side trimming tool 30 does not remove anything, although this should take place accordingly. This may be due for example to the fact that the tree trunk 4 at this point has a flat area or a depression which does not yield any removal. To recognize this reject at the start of the trimming process, following the first trimming tool 30 (see FIG. 3) there can be a sensor 40 which shuts down the system when the sensor 40 does not acquire the presence of wood, therefore for example when the tree trunk 4 has a flattened area. One possible embodiment of the sensor 40 has an obliquely positioned flap 41 with an upper edge 42 which projects somewhat (for example 3 mm) over the plane of the expected machined surface of the tree trunk 4. After for example the tools 30, 32, 34, 35 have been positioned as described above, the computer monitors the feed until the tree trunk 4 has reached the sensor 40. If the latter is not triggered, for example the flap 41 is not swivelled down by the bottom surface of the tree trunk 4 produced by cutting, therefore a "faulty" tree trunk 4 is indicated, the computer shuts off the system. But if machining occurs by the first tool pair 30 (the bottom rough edge is milled off) the flap 41 of the sensor 40 is pressed down and machining of the tree trunk 4 is continued.

Figure 3:
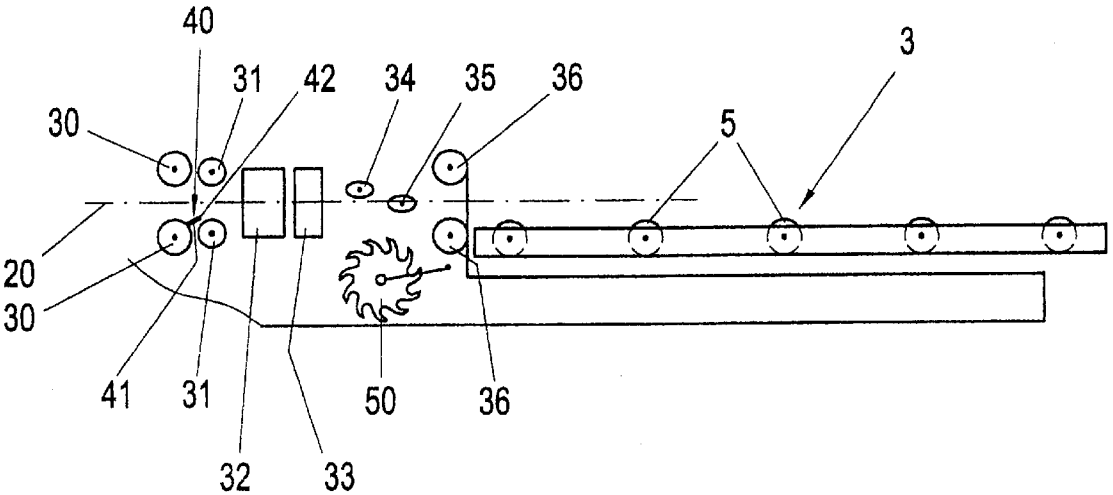
FIG. 3 shows in schematic form the design of the machining center in a first embodiment and FIG. 4 shows in schematic form the design of the machining center in a second embodiment.

In the embodiment shown in FIG. 3 it is shown that a saw blade 50 is assigned to the machining center 2 with which a lengthwise groove can be cut into the squared timber produced in the machining center 2 from at least one side. There can be several saw blades 50 next to one another and several on top of one another in order to be able to cut grooves into the square timber from both sides.

Instead of one or all mechanical sensors, test fingers, operating levers, etc, there can also be optical sensors, such as (reflection) photoelectric barriers or (capacitive) switches or sensors which trigger movements of parts of the device of the invention.

In summary, one embodiment of the device as claimed in the invention can be described as follows:

A means for producing squared timber from tree trunks has a feed section 1, a machining center 2, and a delivery section 3. In the feed section 1 there are at least two grippers 10 which can be placed against the tree trunk 4 to be machined and using which the tree trunk 4 is supplied to the machining center 2. In the machining center 2 there are several plan cutters 30, 32, 34, 35 and feed rollers 31, 33, 36 in order to advance the tree trunk 4, while it is machined by cutting at the desired location in order to produce for example a square beam from the tree trunk 4. The square beam is transported from the machining center 2 onto the delivery section 3 and then removed for further machining. The grippers 10 are preferably made such that they hold the tree trunk 4 regardless of its diameter at a height which at least roughly corresponds to the axis 20 of the machining center 2.

What is claimed is:

1. A device for producing squared timbers from tree trunks (4), comprising:

a machining center (2);

a feed section (1) located in front of the machining center (2) as viewed in the machining direction;

a delivery section (3) located after the machining center (2) as viewed in the machining direction; and two grippers (10) located on carriages (11) on the feed section (1), the grippers being movable relative to the machining center (2) and arranged for pushing tree trunks (4) to the machining center (2), the two grippers (10) having fork tongs, each gripper (10) having two sides (13) with extension arms (15) joined to one another to swivel around a common axis (14) located underneath an axis (20) of the machining center (2), the extension arms (15) pointing downward from the carriages (11) and the axis (20) of the machining center (2), and the grippers (10) being arranged to be closed by swivelling their sides (13) concentrically to the axis (20) of the machining center (2), wherein the tree trunks (4) are held by the sides (13) of the grippers (10) with an axis which lies essentially in the axis (20) of the machining center (2).

2. The device of claim 1, wherein the feed section further comprises:

a bed-shaped frame (12); and guide rails mounted on the bed-shaped frame (12), the carriages (11) being movably mounted on the guide rails.

3. The device of claim 1, wherein the grippers further comprise:

a hydraulic cylinder (16); and two connecting rods (17), the hydraulic cylinder (16) being operatively connected to engage the sides (13) via the two connecting rods (17).

4. The device of claim 3, wherein the sides (13) of the grippers (10) have V-shaped recesses (21) with edges (22, 23) arranged to contact against and hold the tree trunk (4).

5. The device of claim 4, wherein a center of a surface bounded by the V-shaped recesses (21) is in the axis (20) of the machining center (2).

6. The device of claim 4, wherein the edges of the V-shaped recesses comprise lower edges (22) and upper edges (23), and the lower edges (22) are longer than the upper edges (23).

7. The device of claim 6, wherein the grippers each further comprise an upper portion and a reversible roll (24) is attached to the upper portion.

8. The device of claim 4, wherein at least one of the grippers further comprise an operating lever (25) assigned to a bit area formed by the V-shaped recesses (21) in the sides (13), and operatively connected to the hydraulic cylinder (16) so that the lever triggers actuation of the hydraulic cylinder (16) to close the grippers (10).

9. The device of claim 8, wherein the operating lever (25) is connected to a valve (26) joining the hydraulic cylinder (16) to an hydraulic fluid storage tank.

10. The device of claim 1, further comprising at least one feed drive (27, 28) connected to at least one of the two carriages (11) for positioning the grippers (10) in the direction to the machining center (2).

11. The device of claim 10, wherein there is only one feed drive, the sole feed drive being connected to the carriage (11) most remote from the machining center (2).

12. The device of claim 1, wherein the gripper (10) located most near the machining center (2) further comprises a sensor, the sensor connected to open the gripper and thereby cause the sides of the gripper to be released from a contained tree trunk, when the gripper is proximate the machining center (2).

13. The device of claim 1, wherein the carriage located most remote from the machining center further comprises a sensor, and the sensor is arranged to shut down a carriage feed when the most-remote carriage is proximate the carriage most near the machining center.

* * * * *